US007428918B2

(12) United States Patent
Martin

(10) Patent No.: US 7,428,918 B2
(45) Date of Patent: Sep. 30, 2008

(54) CONTROLLED DESCENT DEVICE

(75) Inventor: David O. Martin, Salt Lake City, UT (US)

(73) Assignee: Martin Door Manufacturing, Inc., Salt Lake City, UT (US)

( * ) Notice: Subject to any disclaimer, the term of this patent is extended or adjusted under 35 U.S.C. 154(b) by 219 days.

(21) Appl. No.: 11/199,022

(22) Filed: Aug. 8, 2005

(65) Prior Publication Data

US 2006/0231217 A1 Oct. 19, 2006

Related U.S. Application Data

(60) Provisional application No. 60/672,763, filed on Apr. 19, 2005.

(51) Int. Cl.
*E05D 15/00* (2006.01)

(52) U.S. Cl. ..... 160/191; 160/302

(58) Field of Classification Search ..... 160/191, 160/192, 8, 133, 201, 300, 301, 302, 296, 160/193; 49/322, 200; 16/198; 188/82.7, 188/82.77

See application file for complete search history.

(56) References Cited

U.S. PATENT DOCUMENTS

| | | | | | |
|---|---|---|---|---|---|
| 610,256 | A | | 9/1898 | Brown | |
| 753,135 | A | | 2/1904 | Hanford | |
| 1,863,961 | A | * | 6/1932 | Ball et al. | 160/189 |
| 2,511,697 | A | | 6/1950 | Clift | 187/90 |
| 2,878,865 | A | * | 3/1959 | Manley | 160/189 |
| 3,842,892 | A | * | 10/1974 | Stieler | 160/133 |
| 4,112,996 | A | * | 9/1978 | Fohl | 160/296 |
| 4,125,142 | A | * | 11/1978 | Fohl | 160/291 |
| 4,856,623 | A | | 8/1989 | Romig, Jr. | 188/180 |
| 5,494,093 | A | * | 2/1996 | Eiterman | 160/300 |
| 5,617,933 | A | | 4/1997 | Ericson | 187/350 |
| 5,971,055 | A | * | 10/1999 | Rohaut | 160/300 |
| 6,042,158 | A | | 3/2000 | Horn | 292/165 |
| 6,148,979 | A | | 11/2000 | Roach et al. | 192/45.1 |
| 6,189,266 | B1 | | 2/2001 | Mihalcheon | 49/322 |
| 6,206,078 | B1 | | 3/2001 | Frey, Jr. | |
| 6,279,268 | B1 | | 8/2001 | Beaudoin et al. | 49/322 |
| 6,557,301 | B1 | | 5/2003 | Hormann et al. | 49/139 |
| 6,655,088 | B1 | * | 12/2003 | Hormann | 49/200 |
| 6,691,834 | B2 | | 2/2004 | Sanchez et al. | 187/373 |
| 6,715,236 | B2 | | 4/2004 | Mullet | 49/322 |
| 6,742,564 | B2 | | 6/2004 | Martin | 160/201 |
| 6,986,378 | B2 | | 1/2006 | Beaudoin et al. | |
| 7,254,868 | B2 | * | 8/2007 | Mullet et al. | 16/198 |
| 2002/0069585 | A1 | * | 6/2002 | Schiks | 49/200 |

(Continued)

*Primary Examiner*—David Purol
(74) *Attorney, Agent, or Firm*—Kirton & McConkie; David B. Tingey

(57) ABSTRACT

Hardware that improves the safety of operating sectional doors that use torsional coil springs to facilitate door movement. A rotor assembly with centrifugally activated throw-out latches is affixed to the rotating shaft that bears the torsional coil springs. When a spring breaks, the shaft rotates rapidly as cables supporting the door unwind. Rapid rotation causes centrifugal force to bias the latches to an outer position in which they strike a trigger plate, allowing a pawl to move into a position in which the pawl blocks further rotation of the rotor, thus halting the descent of the sectional door. Raising the sectional door manually moves the latches, trigger plate, and pawl to their original position, disengaging the present invention and permitting the door to be lowered slowly without danger of injury.

18 Claims, 11 Drawing Sheets

U.S. PATENT DOCUMENTS

2002/0109359 A1 8/2002 Nodorft ..... 292/137
2003/0221801 A1 * 12/2003 Beaudoin et al. ..... 160/191
2005/0109473 A1 * 5/2005 Bresson ..... 160/191

* cited by examiner

CONTROLLED DESCENT DEVICE

BACKGROUND OF THE INVENTION

1. Related Applications

This application claims priority to U.S. provisional application Ser. No. 60/672,763, filed Apr. 19, 2005.

2. Field of the Invention

The present invention relates to sectional doors and related safety devices. More particularly, the present invention relates to novel hardware devices designed to improve safety and minimize the risk involved in operating sectional doors that utilize spring mechanisms to facilitate door movement.

3. Background

Large doorways in garages, shops, stores, warehouses and other buildings often use sectional doors to enclose the doorway opening. These doors are generally constructed of wood, vinyl, fiberglass, or metal panels which are joined by hinges and hung from rollers which travel along a fixed track at each side of the door. Sectional doors typically range in size from small storage unit models of just a few feet wide to very large models which accommodate trucks and heavy equipment. Sectional doors are used for residential garages in sizes sufficient to accommodate either one or two vehicles.

The size of sectional doors and the weight of their materials make them relatively heavy and, therefore, difficult to lift without assistance. Many doors also contain insulation and other materials which further add to the door's weight. Even an average-sized residential garage door can weigh several hundred pounds, making it impossible for the average person to lift without assistance.

As a consequence of the weight of sectional doors, mechanisms have been invented to counteract the door's weight, thereby allowing manual operation of the door. The most common method of counteracting a door's weight is accomplished with a counter-spring mechanism using a spring or springs which are displaced elastically as the door is shut, thereby exerting a lifting force on the door as it is closed. This spring force keeps the weight of the door in balance during movement.

Coil springs, in a torsion spring configuration, are often used for these mechanisms. In a torsion spring configuration, the coil spring is deflected or wound around the axis of its helix. In a typical coil spring configuration, as shown in FIGS. 1 and 2, one or more coil springs are wound around a shaft near the top of the door. One end of each coil spring is attached to a mounting bracket which is affixed to the building structure or to the metal frame in which the sectional door is mounted. The other end of the spring is attached to a torsion shaft. A cable drum is likewise mounted on the shaft. A cable is wound around the cable drum. The cable extends to the bottom of the door where it attaches to a bracket. These coil springs are sized and pre-wound or pre-tensioned to ensure that the door remains in balance through the entire path of movement of the door, between closed and open, or open and closed positions.

As the door closes, the cable unwinds from the cable drum thereby twisting the spring and increasing the torsion on the spring and the energy stored within the spring. A properly adjusted spring mechanism will exert a force on a door that is about the same as the weight of the door, allowing a user to open the door with the slightest of lifting effort. This means that the ideal spring mechanism, on an average door, will need to store an amount of energy that is approximately equal to the weight of the door. In terms of force and considering the lever arm of the cable drum, the spring exerts a force of at least twice the weight of the door. Consequently, these spring mechanisms store a great deal of energy that is unleashed as a twisting force. Because of the tremendous forces involved, even well-maintained coil springs will eventually weaken or break. When a spring weakens, the door is no longer in balance. When a spring breaks, it unwinds around its helical axis and releases the stored energy that was balancing the weight of the door.

The coil springs are most likely to break when a door is closed, because that is the point in the traverse of the door when the force stored in the coil spring is greatest—the coil spring is at that point ready to assist in lifting the door. Breakage can occur, however, at any point. This is particularly true in many modern residential and industrial applications where an electric garage door opener is in use. The majority of doors in such situations use more than one coil spring, but the power of an electric garage door opener enables that device to lift the door in many cases when one of the coil springs is weakened or broken, unbeknownst to the user of the door.

When a single remaining coil spring breaks, the only counter-balancing force to the full weight of the door is found in any electric garage door opener that may be attached to the door. These openers are not designed to bear the weight of the door without any assistance from the coil springs. In any case where all the coil springs break, the door will effectively be without a force to counter its full weight. If the coil springs break when the door is fully closed, the door will likely be impossible for an individual to lift without assistance. More troubling, if the coil springs break when the door is not fully closed, the full weight of the door will force it to a closed position, posing a threat of serious injury or even death to any person or animal that lies in its path as it falls. A particular danger may be that of residential homeowners or their children who, unaware that a spring is weakened or broken, release the door's connection to a garage door opener, and then attempt to block the path of a falling door without the benefit of the counterbalancing effect of one or more broken or weakened coil springs.

Inventions in the prior art have used a number of techniques to stop the instantaneous free-fall of a door in a situation where either the coil springs break or are weakened.

In some industrial applications, a hydraulic mechanism is used that restricts the speed of rotation of a cam or drive wheel associated with the door lift mechanism. In these devices, a fluid flows through chambers as the door is raised or lowered. By controlling the size of chambers and the viscosity of the fluid, the amount of force needed to rotate the drive wheel can be changed. Manufacturers select specifications in which the weight of a free-falling door does not provide a sufficient force to rotate the drive wheel at greater than a safe speed, thus controlling the speed of descent for the door. Unfortunately, these hydraulic devices are expensive to manufacture and maintain, and thus inappropriate for many small industrial and residential sectional garage doors.

Solutions used for sectional doors have most often used a mechanical tensioning device to detect a slackening of the tension in a coil spring mechanism. Such a slackening indicates that the coil spring no longer provides a balancing force to the weight of the door. When tension is released in the coil spring, these prior art devices use various techniques to stop the movement of the door.

Although these prior art inventions are effective when a coil spring breaks, they are much less helpful when a coil weakens or is installed incorrectly. A spring that has weakened or that has been incorrectly adjusted or installed generally provides enough tension that a prior art safety device will not detect that a spring is now exerting a much-reduced lifting force on the door. If one or both springs become weakened, the door may drop unexpectedly without triggering a prior art safety device. Such an event might also occur if a user releases a door having a weakened spring from a garage door opener that was preventing the door from falling.

Prior art safety devices pose another potentially serious problem when coil springs break, triggering these devices. Prior art safety devices are typically designed to stop all downward movement of the door, rather than simply the overly rapid descent that poses a danger to users. Because the breakage of a coil spring is most likely to occur when a door is at or near a closed position, the contents of the garage or building are likely to be "locked inside" by these prior art safety devices until a qualified repair technician can arrive on site. Given human nature and the pressures of modern life, an unwary home or business owner is highly likely to attempt to disable or disengage the safety device in order to remove a vehicle, secure a dwelling, or for similar purposes. Individuals who do not understand the mechanisms and forces involved will assume they can manually manipulate the door. Serious injury may result from an attempt to disable or disengage prior art safety devices in order to permit such manual operation.

It is evident, then, that what is needed is a safety device that will prevent the rapid and dangerous descent of a door but not prevent all downward door movement. Such a device would protect against injury by a heavy, falling door. It would also allow a user to disengage the safety device, raise a door with assistance, then carefully lower it to a closed position, or otherwise operate it manually, all the while being protected from grave injury by a safety device that stops a rapid and perilous falling door. Ideally, the invention would allow intuitive use, where a user who has not read an operator's manual can "figure out" how to operate a disabled sectional door manually without risking injury.

SUMMARY OF THE INVENTION

The present invention reduces or eliminates the safety hazards posed by broken or weakened coil springs in a sectional door lift mechanism. It also reduces or eliminates the limitations and safety hazards of prior art devices as they relate to stopping a falling door.

Unlike devices in the prior art that detect only a broken spring, the present invention detects overly rapid descent based upon the speed of rotation of the shaft on which the coil spring mechanism is mounted. If the shaft rotates at too high a speed, the device in the present invention is activated and stops the descent of the door. If a user then raises the door a few inches, the mechanism of the present invention resets, allowing the user to lower the door at a slow rate of speed. If the user slips or moves the door too rapidly, the device reengages to prevent injury. The device may be reset and reengaged repeatedly to allow manual operation while protecting against the dangerous and overly rapid descent of a falling door.

A preferred embodiment of the present invention relies on centrifugal force to activate a means for stopping the descent of a sectional door when the coil-bearing shaft rotates at an excessive rate of speed. In one embodiment, a rotor assembly is mounted about the coil-bearing shaft. This assembly includes at least one elongate latch attached by one end near the perimeter of the rotor. During normal operation of a sectional door, the coil-bearing shaft rotates at an acceptable rate of speed. As the rotor rotates, the latch rotates freely, under the influence of gravity, between a position substantially parallel to the perimeter of the rotor and a position extended from the rotor. When the coil-bearing shaft rotates rapidly, as when a sectional door begins a dangerous free-fall, the latch is thrown by centrifugal force into an outer position. In that outer position, the latch engages a trigger plate. The trigger plate rotates around the coil-bearing shaft and releases a catch that holds back a pawl. The pawl is pulled upwards toward the rotating rotor by a spring attached to the trigger plate. The rotor contains at least one protrusion, which strikes the pawl and halts the rotation of the rotor, and thus the rotation of the coil-bearing shaft. Because the coil-bearing shaft is connected to the descending door by one or more cables, when the shaft ceases to rotate, the descent of the door also ceases.

If a user thereafter lifts the door manually, the rotor will be rotated in a direction opposite to the direction of when the door was falling. The pawl will be pushed out of the path of the rotating rotor and the trigger plate will be pulled back to its original position. The latch, which was thrown into an outer position by centrifugal force, will fall back to an inner position because of the slow rotation of the rotor and coil-bearing shaft. The user could continue to raise the door manually, or could lower the door at a slow rate of speed. If the weight of the door caused the user to inadvertently release the door, the rotor assembly would again spin rapidly, and centrifugal force would throw the latch to the outer position, once again hitting the trigger plate, permitting the pawl to be pulled into a position that again stopped the free-falling door.

The maximum distance that the door could descend in free-fall is determined in this embodiment by the number of protrusions on the rotor and the circumference of the cable drum on which the door lift cable was mounted. For example, if the cable drum has a circumference of 12 inches and the rotor contains three protrusions, the maximum distance that the door can free-fall before a protrusion strikes the pawl is 120 degrees of arc around the 12 inches of circumference—about 4 inches.

While the methods and processes of the present invention have proven to be particularly useful in the area of sectional doors, those skilled in the art can appreciate that the methods and processes may be useful in a variety of different applications and in a variety of different areas of manufacture where they have not heretofore been used, and where such use would yield improved safety or control of mechanical devices. Any number of devices that include a rotating shaft or disc might benefit from the present invention as a way to halt overly rapid movement of component parts.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
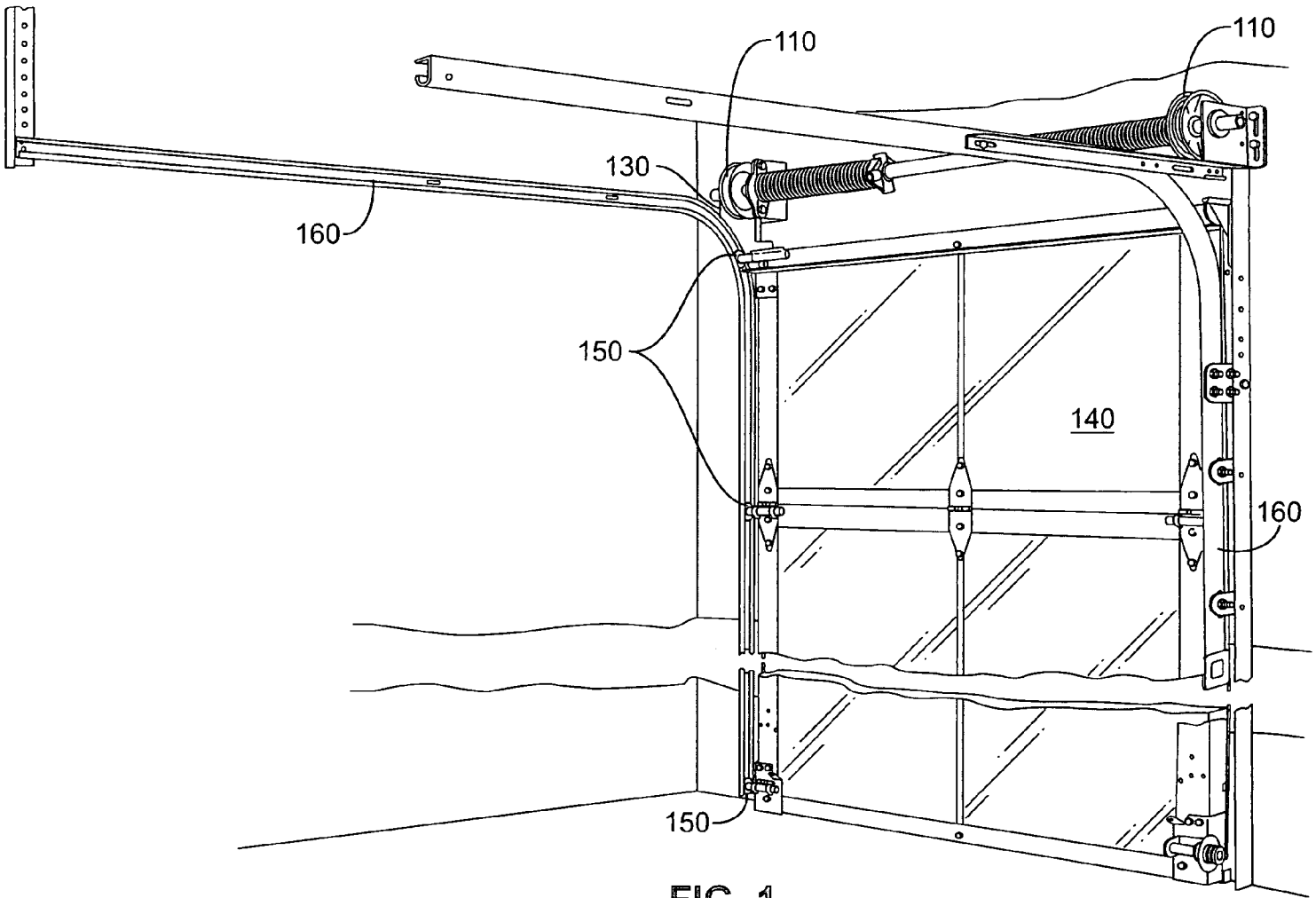
FIG. 1 Prior Art
FIG. 1 illustrates a representative system in the prior art that provides a suitable operating environment for use of the present invention.
Figure 2:
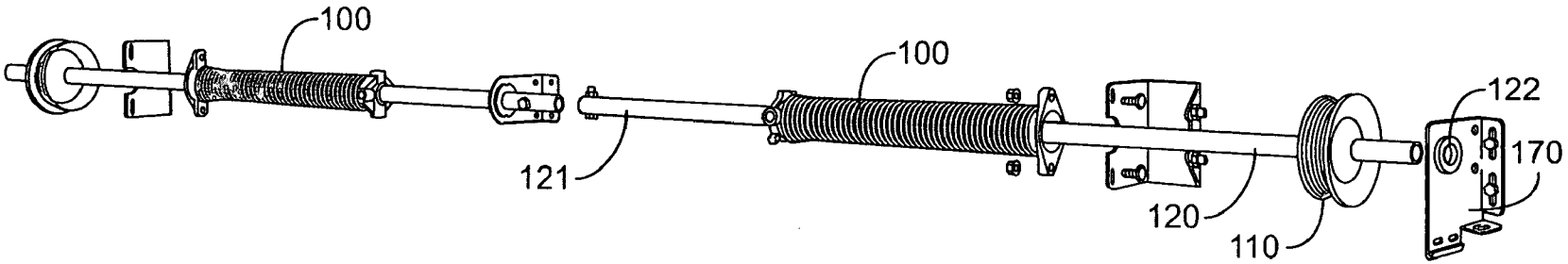
FIG. 2 Prior Art
FIG. 2 illustrates a shaft and torsion spring assembly in the prior art, on which the present invention is typically installed.
Figure 3:
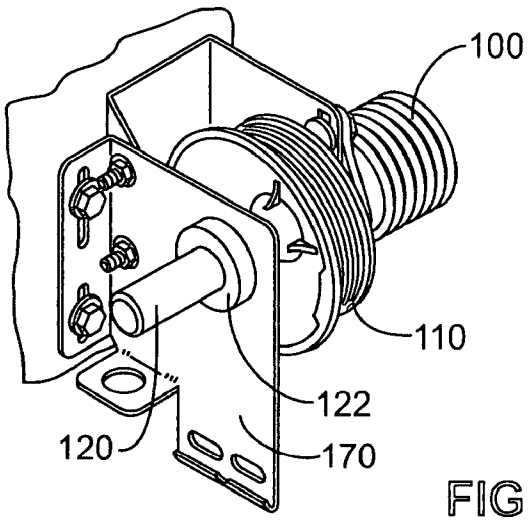
FIG. 3 Prior Art
FIG. 3 illustrates one end of the shaft and torsion spring assembly shown in FIG. 2, as they exist in the prior art.
Figure 4:
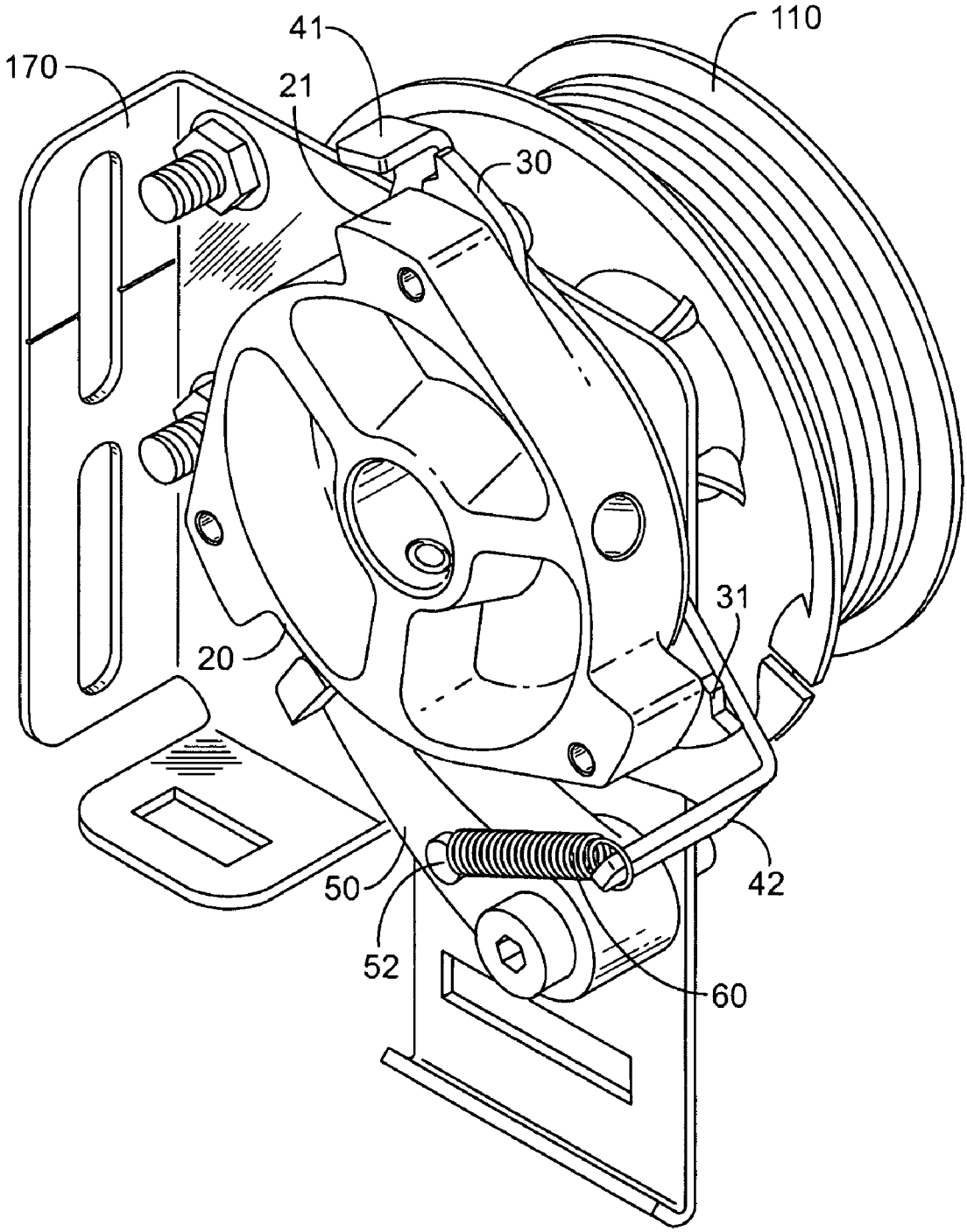
FIG. 4 shows a view of a preferred embodiment of the present invention.

The figures listed above are expressly incorporated as part of this detailed description.

It will be readily understood that the components of the present invention, as generally described and illustrated in the Figures herein, could be arranged and designed in a wide variety of different configurations. Thus, the following more detailed description of the embodiments of the present invention is not intended to limit the scope of the invention as claimed, but is merely representative of the presently preferred embodiments of the invention.

The presently disclosed embodiments of the invention will be best understood by reference to the drawings, wherein like parts are designated by like numerals throughout.

The term "conventional fasteners" as used in this document refers to fasteners for connecting metal, wood, plastic and other materials common in sectional door construction. By way of example and not limitation, these fasteners comprise screws, bolts, nuts, washers, rivets, cotter pins, clevis pins, studs, threaded rods and other mechanical fasteners as well as adhesives such as epoxy, welding joints such as spot welds and conventional fillet and butt joint welds.

A "non-fastener structure" is a device that does not hold the items of its connection in a fixed physical relationship without other support, force or torque. A non-limiting example of a non-fastener structure is a hook, such as a hook which engages an element but only remains in contact with that element while a force acts on the hook, pulling it against the element.

A "torsion spring" is an element which is elastically deformed by a torque or rotational force and which counteracts against that torque with an equal, but opposite, torque. The torsion spring may provide the counteracting torque directly by virtue of its shape and configuration or it may counteract the torque indirectly through a mechanism which converts spring force into torque. By way of non-limiting example, a torsion spring may be a helically wound coil spring which is elastically deformed by a rotational motion about its helical axis, or a torsion bar or a leaf spring connected to a lever and gear mechanism which creates torque.

The term "static structure" shall refer to any structure that is substantially static or immovable in response to the forces exerted by a typical sectional door. Examples of static structures, given by way of example and not limitation, are roller tracks, mounting brackets, and residential or commercial building frames including framing elements such as studs, posts, columns, beams, headers, lintels, stem walls, foundation structures and other elements that are assembled into a building frame. Other non-limiting examples of static structures are posts, fences, retaining walls and garden walls. These elements may be constructed of concrete, masonry, lumber, steel, plastic, fiberglass, aluminum or other materials.

The term "counter-spring" shall refer to any type of mechanism which uses elastic deformation of an element's shape to counteract a force or weight. By way of example and not limitation, a counter-spring may take the form of a coil spring which stretches along its helical axis and exerts a force as it is stretched. Also, by way of non-limiting example, a coil spring may be connected coaxially, in a torsion spring configuration, to a pulley or drum so that the spring rotates with the pulley or drum such that a cable wound around the pulley or drum from which an object is suspended would exert a counter-force against gravity, thereby allowing the object to be lifted with a force lesser than the weight of the object.

A specific embodiment of the present invention comprises a novel safety feature for use with a spring-based system of pivotally connected sectional doors, as shown in FIG. 1. This embodiment utilizes a torsion assembly comprising a coil spring 100 and cable drum 110 mounted on a shaft 120. The torsion assembly is connected by cable 130 to sectional door 140. The roll-up door rides on rollers 150 which engage and travel within tracks 160 at each side of the door 140.

When a force such as a garage door opener moves the sectional door 140 downward, cable 130 unwinds from the cable drum 110, causing the shaft 120 to rotate and increasing tension in coil spring 100. When a force moves the sectional door 140 upward, cable 130 winds onto the cable drum 110, causing the shaft 120 to rotate and decreasing the tension in coil spring 100. Importantly, in this system, the shaft 120 and the cable 130 are connected in such a way that whenever the door 140 moves in its track 160, the shaft 120 rotates, and if the shaft 120 cannot rotate, the door 140 cannot move downward.

Structure of a Preferred Embodiment

Figure 6A:
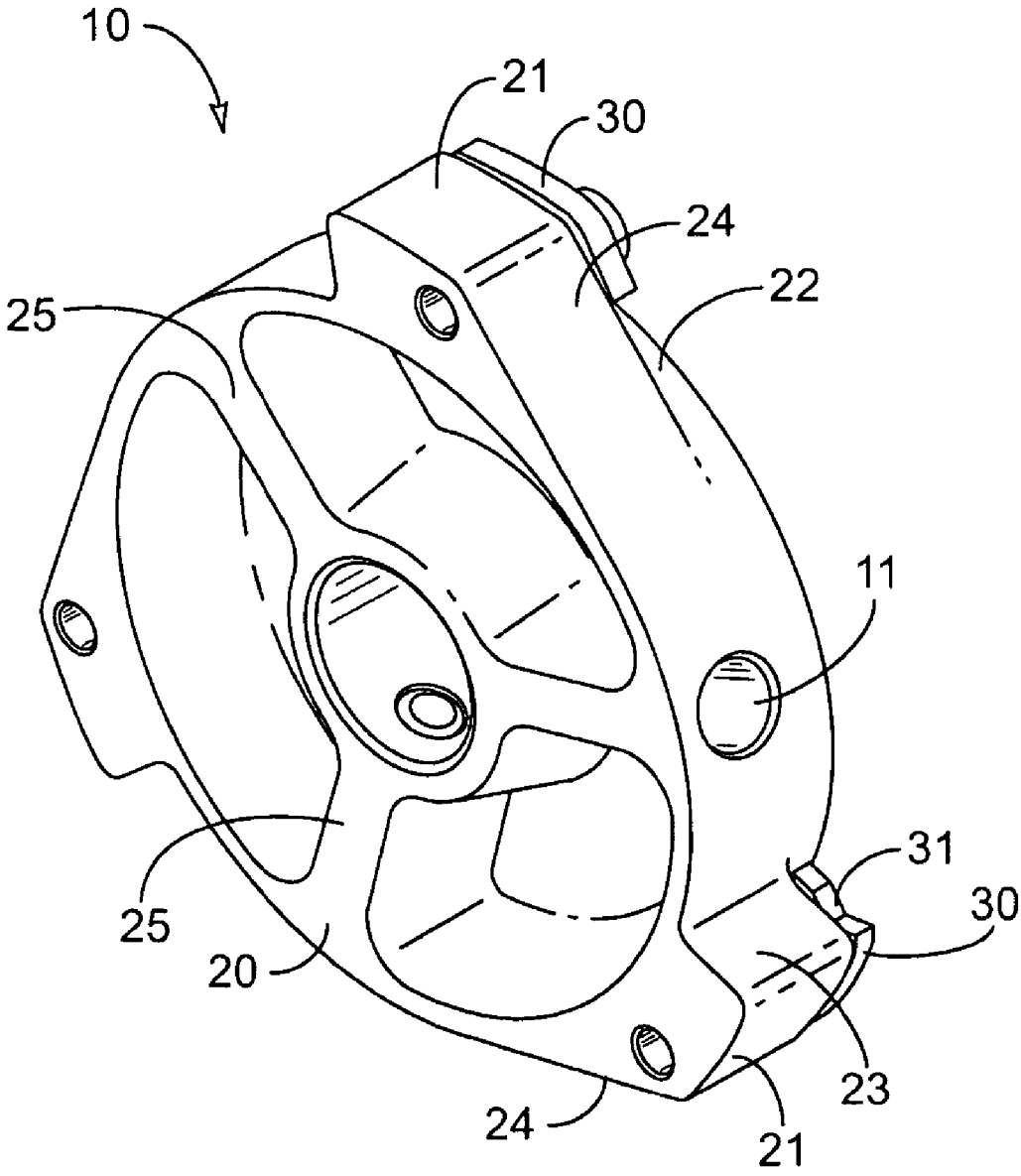
FIG. 6*a* shows the rotor assembly used in a preferred embodiment of the present invention.

In a preferred embodiment of the present invention, a rotor assembly 10, shown in FIG. 6*a*, is fixedly, coaxially mounted on the shaft 120, so that when the shaft 120 rotates, the rotor assembly 10 also rotates; if rotation of the rotor assembly 10 is halted, the rotation of the shaft 120 is also halted. The rotor assembly 10 is attached securely to the shaft 120 so as to withstand significant torque forces during stoppage of a falling sectional door 140, as hereinafter described. One preferred method of securely attaching the rotor assembly 10 to the shaft 120 comprises using one or more set screws that are inserted through a set screw tapped hole 11 and that extend to engage the shaft 120 at the set screw hole 12 in the inner perimeter of the rotor assembly 10. Three set screws are used in a preferred embodiment. The rotor assembly 10 may also be attached securely to the shaft 120 by means of a fastener that extends through at least a portion of the rotor assembly 10 and substantially into or through the shaft 120. The rotor assembly 10 can be retrofitted onto a variety of pre-existing installed sectional door assemblies to provide an added measure of safety as herein disclosed.

Figure 9:
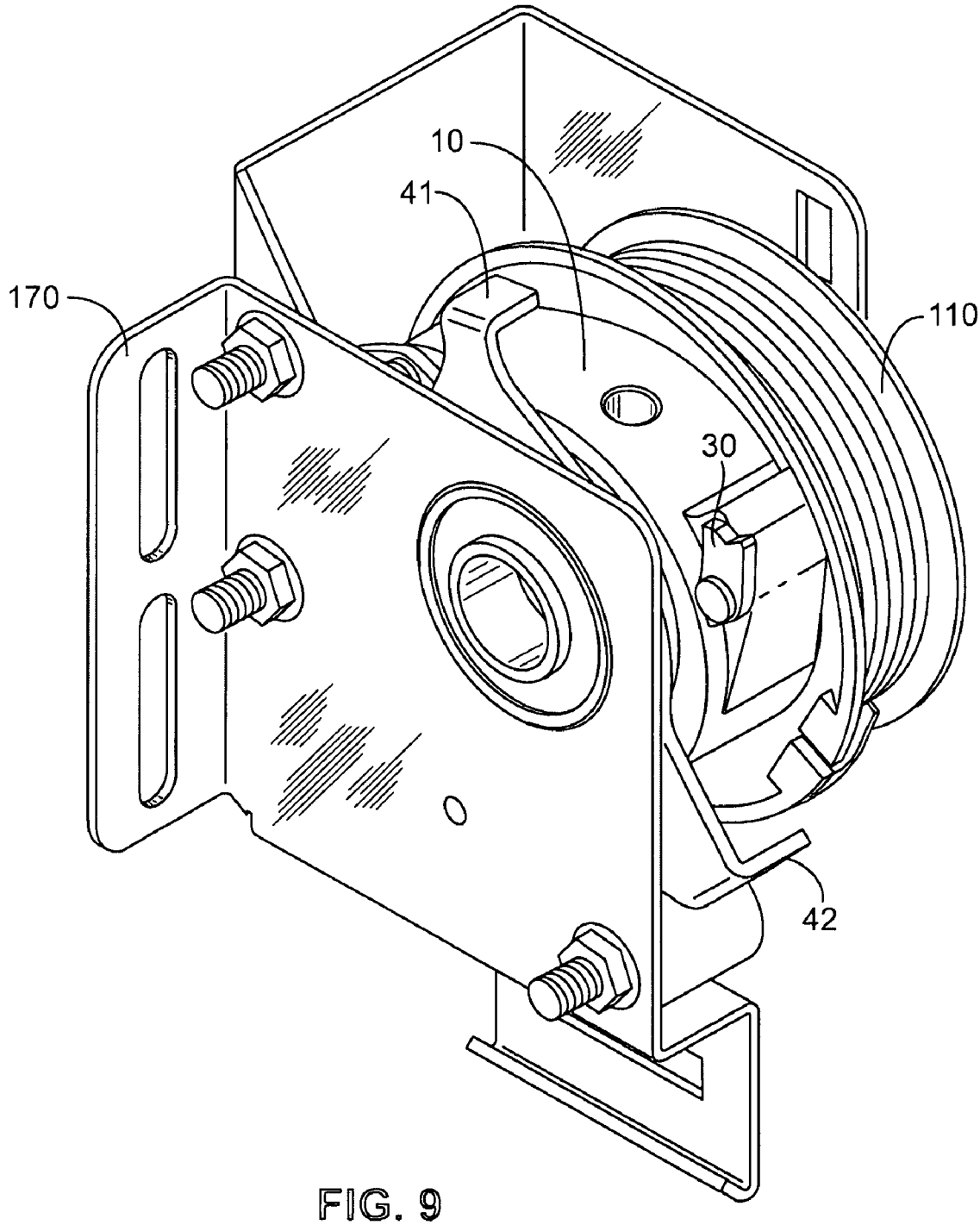
FIG. 9 shows an embodiment of the present invention in which the rotor and cable drum are fashioned as a single component.

In one embodiment, intended primarily for newly installed sectional doors, the cable drum 110 and the rotor assembly 10 as herein disclosed are manufactured as a single component, as illustrated in FIG. 9. This embodiment saves manufacturing costs compared to creating two separate components. It also may make installation easier. Finally, using a single component for cable drum 110 and rotor assembly 10 eliminates the need to transfer torque from the rotor 20, through the set screws, to the cable drum 110, in order to halt a falling sectional door 140.

The rotor assembly 10 comprises a rotor 20 and latches 30. The rotor 20 in a preferred embodiment has a width of approximately 0.75 inches along the longitudinal axis of the shaft 120 and includes, in a preferred embodiment, three protrusions 21 that extend beyond the perimeter of the rotor 20. The width of each protrusion 21 along the longitudinal axis of the shaft 120 is not as great as that of the main body of the rotor 20, leaving a portion 22 of the perimeter of the rotor that is not extended by a protrusion. In a typical sectional door configuration, the cable 130 as described herein is wound on the cable drum 110 so that the rotor 20 rotates clockwise when the sectional door 140 is rising and counter-clockwise when the sectional door 140 is descending. The descriptions that follow assume this configuration, though reversed or altered configurations and viewpoints can easily be imagined using the same principles by those skilled in the art.

Each protrusion 21 on the rotor 20 is configured to include a substantially flat surface 23 on the leading edge of the protrusion during counter-clockwise rotation. This is evident in FIG. 6*a*. Each protrusion 21 is further configured to include a substantially sloped surface 24, smoothly connecting the non-protruding perimeter of the rotor 20 with the extended perimeter of the protrusion 21. This sloped surface 24 is located on the trailing edge of the protrusion 21 during counter-clockwise rotation, as seen in FIG. 6*a*. Similar embodiments having a rotor 20 of varying shapes can be envisioned by those skilled in the art.

The rotor 20 may be constructed of a variety of materials. In this embodiment, cast or machined aluminum is used. The center portion of the rotor may be designed to include a thinner area and spokes 25, so as to reduce the amount of metal used for casting operations. The rotor 20 may also be constructed by a process of metal stamping of a hub section followed by welding multiple protrusions onto the hub; or by forming the rotor 20 from UHMWPE or nylon 66, or a variety of other plastics, composites, or metals.

The rotor assembly 10 in this embodiment further includes one or more latches 30. In this preferred embodiment, three latches 30 are used, each located adjacent to a protrusion 21; these latches 30 are made of a substantially planar piece of material. In this embodiment, 12 gauge galvanized steel is used, though any other material known in the art that can be formed with sufficient precision, via stamping or otherwise, may also be used. The latches 30 are substantially elongate and trapezoidal in shape, having a notch 31 in one end. The un-notched end of each latch is attached to the rotor 20, near the perimeter of the rotor 20, using a fastener 32 that permits the latch 30 to rotate freely about the fastener 32. The latch 30 is constrained in its rotational movement by the shape of the rotor 20 and the trapezoidal shape 33 of the ends of the latch 30, so that it moves freely only between a first position that is substantially parallel to the perimeter of the rotor 20, and a second position that is extended from the perimeter of the rotor as the trapezoidal shape 33 presses against the edge 22 of the rotor 20.

During normal, slow rotation of the rotor 20, the latches 30 move back and forth between the first latch position and the second latch position. When a latch 30 is rotated to the bottom part of the rotor 20, the latch 30 falls to the second latch position in which the latch 30 is extended to the limit of its free movement. When the latch 30 is rotated to the top part of the rotor 20, the latch 30 falls into the first latch position in which it lies substantially parallel to the perimeter of the rotor 20. If, however, the rotor 20 spins rapidly, centrifugal force will cause the latch 30 to remain in the second latch position even when the latch 30 is rotated to the top part of the rotor 20 where gravity would otherwise cause the latch 30 to fall back to the first latch position. A similar result could be obtained by relying on latch mechanisms that were biased with springs on a rotor oriented in a non-vertical plane.

Figure 6B:
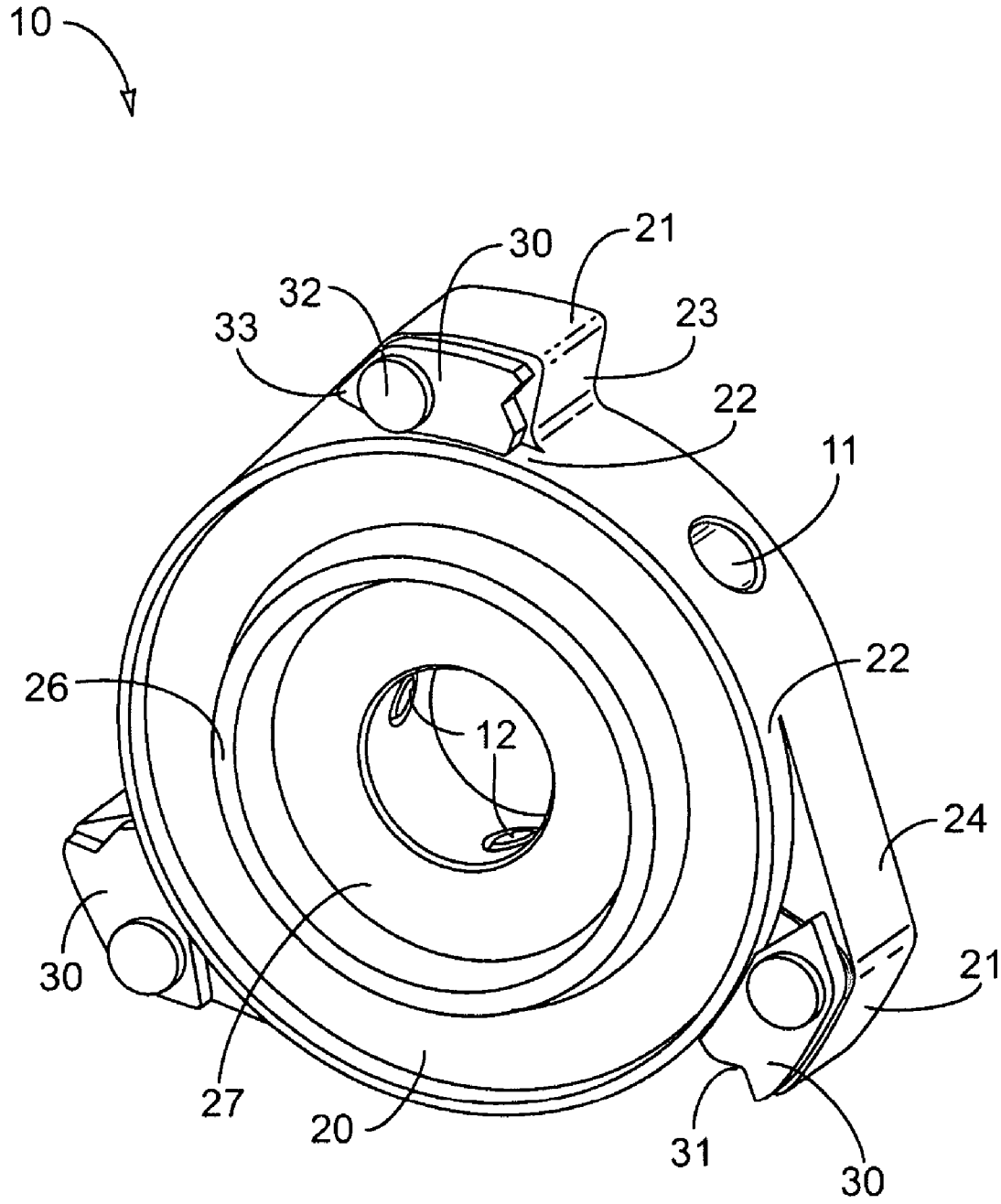
FIG. 6*b* shows the rear side of the rotor assembly used in a preferred embodiment of the present invention.
Figure 7A:
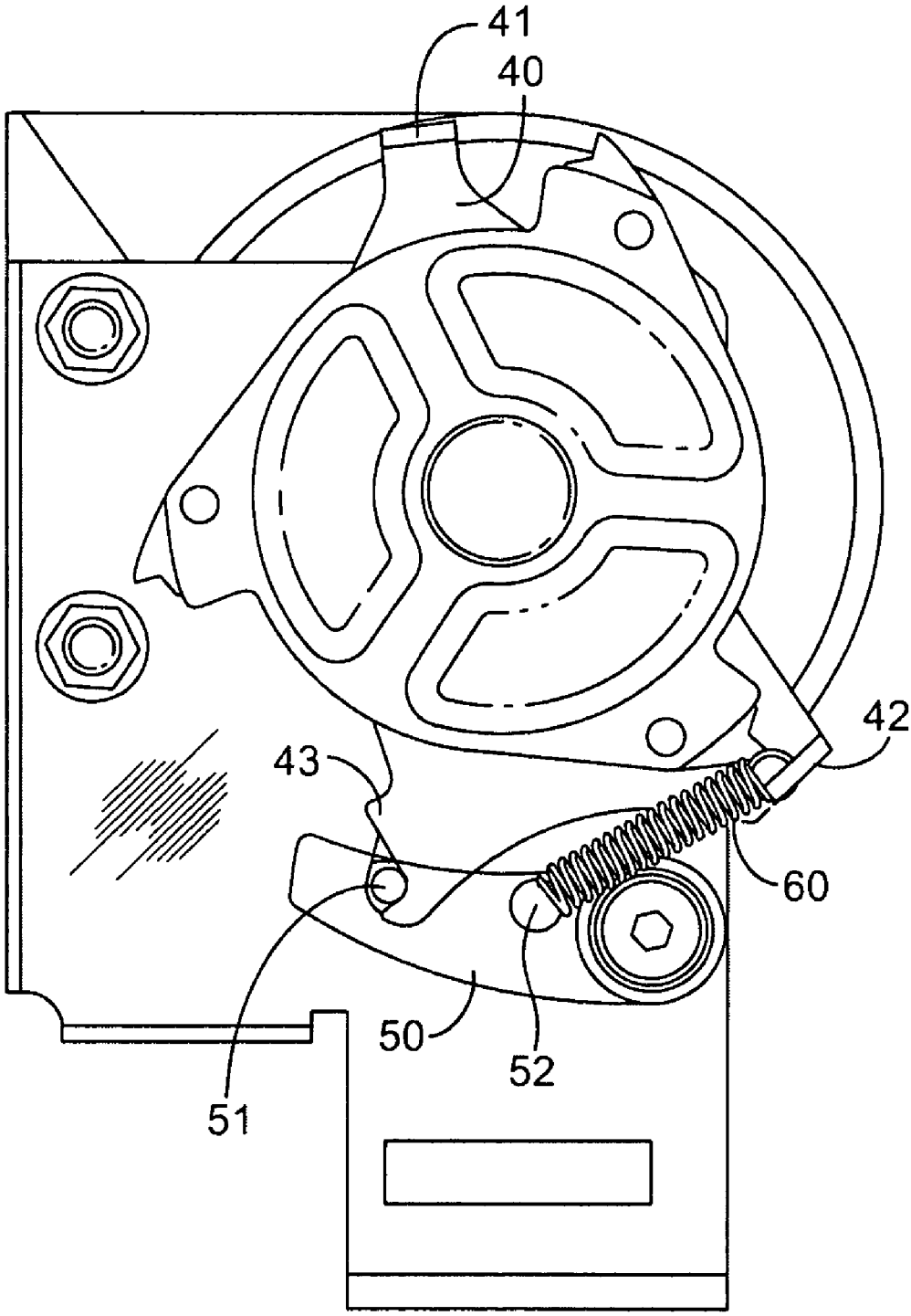
FIG. 7*a* shows the present invention during normal operation of a sectional door.
Figure 7B:
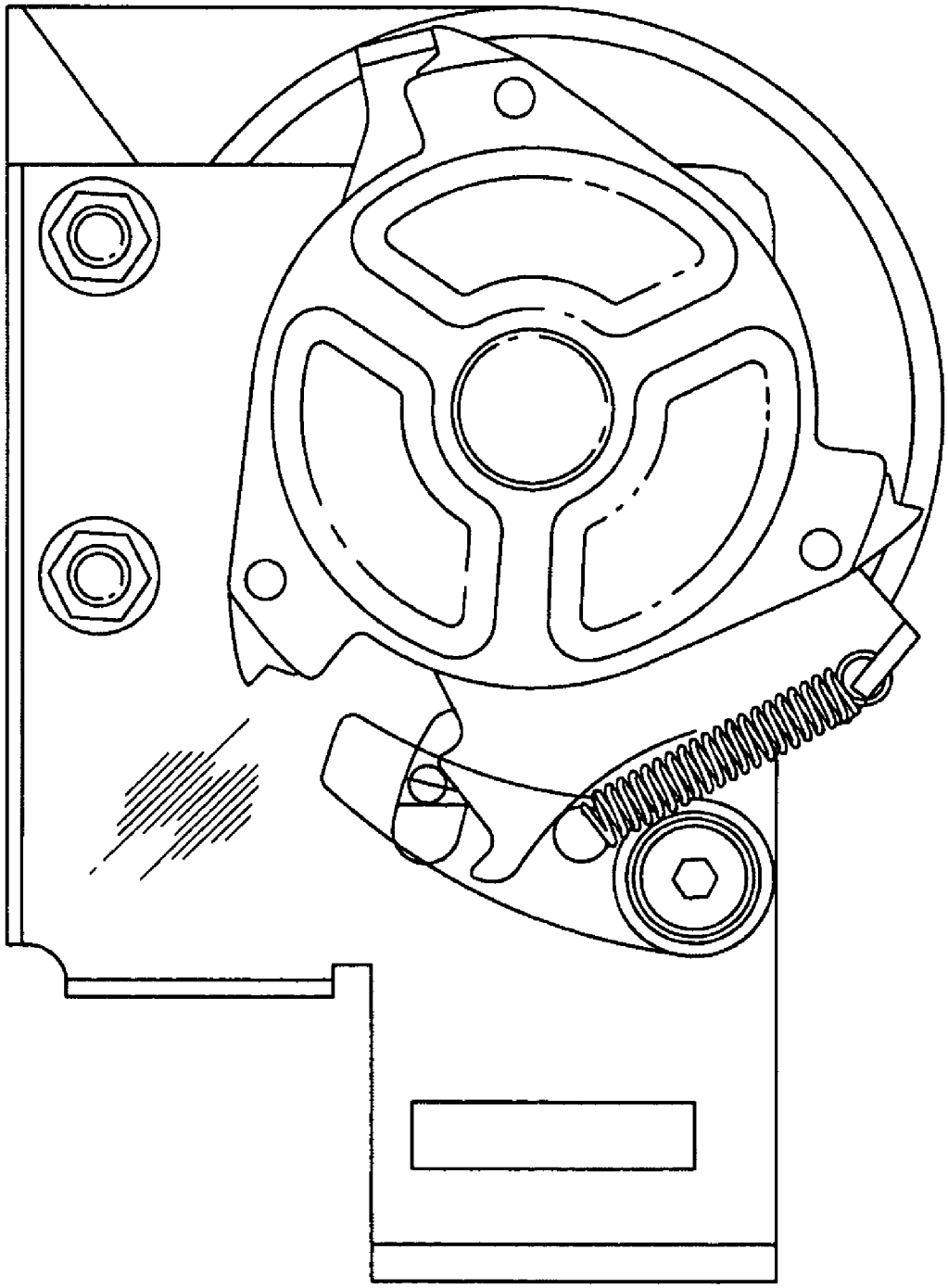
FIG. 7*b* shows the present invention during engagement caused by overly rapid descent of a sectional door.
Figure 7C:
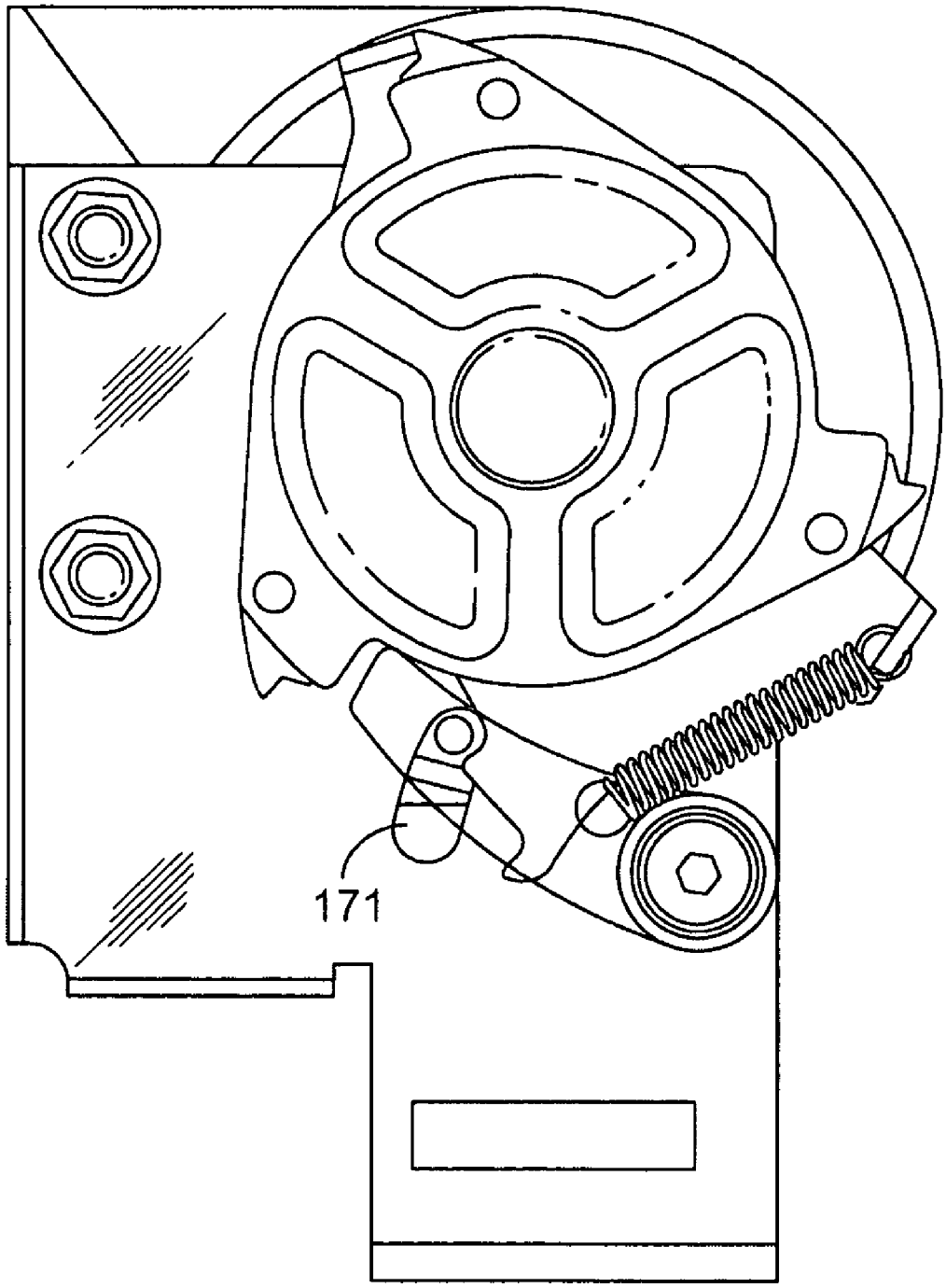
FIG. 7*c* shows the present invention fully engaged, as caused by overly rapid descent of a sectional door.

This preferred embodiment, as shown in FIGS. 7*a* through 7*c*, includes a plate 40 that is typically mounted in the vicinity of rotor assembly 10. In a preferred embodiment, plate 40 is made from 12-gauge galvanized steel and is mounted on the shaft 120, adjacent to the rotor assembly 10. The mounting hole in the plate 40 is large enough to permit the plate 40 to fit over the bearing 122 in which the shaft 120 rotates. The rotor 20 has a space 27 formed near its inner diameter so that during rotation, the rotor 20 does not contact the body of the bearing 122 in which the shaft 120 rotates, but only contacts the bearing race. A ridge 26 protrudes from the rotor 20 outside the perimeter of the bearing 122 so that it touches the plate 40. FIG. 6*b* shows the back side of the rotor 20 where it is assembled against the plate 40. The plate 40 is not fixed to the shaft 120 or rotor 20, but can remain stationary as the shaft 120, rotor 20, and cable drum 110 rotate. Though a variety of materials can be used for the rotor 20 and plate 40, two different metals are used in this embodiment. As the rotor 20 rotates against the stationary plate 40, the softer aluminum of the rotor 20 in this embodiment is polished to form a smooth surface, permitting quieter operation.

The plate 40 includes a flange 41 near its top portion. The flange 41 extends over the top of the rotor assembly 10. The plate 40 in this embodiment also includes a means for attaching a spring to plate 40. Typically, this means is a second flange 42 with a hole drilled through it or a small hook to which spring 60 or other means can be attached for biasing the movement of plate 40. In a preferred embodiment, a hook is used to permit easy attachment of spring 60.

Plate 40 further includes a means for restraining the movement of the pawl 50. This means is typically a notch 43 in the planar surface of plate 40. Both the second flange 42 and the notch 43 are typically located in the bottom portion of plate 40.

A preferred embodiment also includes a pawl 50. Pawl 50 is not mounted coaxially with the rotor assembly 10 in a preferred embodiment. One end of pawl 50 is mounted so that when the pawl 50 rotates about its mounting point, pawl 50 engages a flat surface 23 of rotor 20 when rotor 20 rotates in a counter-clockwise direction. Pawl 50 is typically mounted near rotor 20 on a static structure such as the bracket 170 that holds the shaft 120. The rotor 20 and pawl 50 are configured so that when the rotor 20 rotates in a clockwise direction as the sectional door 140 is raised, the pawl 50 does not engage flat surface 23 or otherwise interfere with the free rotation of the rotor 20.

Pawl 50 can be made of any suitable material, including a variety of metals or plastics. In the preferred embodiment, cast or machined aluminum is used.

In a preferred embodiment, pawl 50 includes a means for holding the pawl in position, which maintains the position of pawl 50 when plate 40 is in its first position. A preferred means for holding pawl 50 in position is a pin 51 positioned near the free end of pawl 50. In a preferred embodiment, a small hole 171 is formed into bracket 170 on which pawl 50 is mounted to prevent any binding or interference with the movement of pawl 50 caused by scraping against bracket 170 or other static structures. When the plate 40 is in a first position, pin 51 engages notch 43 on plate 40. In this position, pawl 50 cannot move. Pawl 50 also comprises a means for attaching coil spring 60 or other means for biasing the movement of pawl 50. In a preferred embodiment, the means for attaching coil spring 60 may be a pin 52 extending horizontally from pawl 50, formed such that coil spring 60 or other means for biasing the movement of pawl 50 can be attached to pawl 50.

Operation of a Preferred Embodiment

This section describes the functioning of the present invention in a preferred embodiment as just described and as illustrated in FIGS. 7*a* to 7*c*.

During normal operation of the sectional door 140, rotor 20 rotates about its axis and latches 30 move cyclically under the influence of gravity from a first latch position to a second latch position and back as the rotor 20 rotates. Plate 40 does not move; pawl 50 does not move. This is shown in FIG. 7*a*.

Imagining now that sectional door 140 begins a dangerously rapid descent, shaft 120 rotates rapidly in a counter-clockwise direction as the falling sectional door causes cable 130 to unwind rapidly from cable drum 110. Rotor assembly 10, which is securely attached to shaft 120, also rotates rapidly. As rotor assembly 10 rotates rapidly, centrifugal force causes latches 30 to remain in a second latch position in which they extend beyond the protrusions 21 in the rotor 20 during their entire rotational circuit, even when positioned at the top of the rotor 20 where gravity would otherwise cause them to fall into a first latch position.

In the second latch position, the latch 30 nearest the top of the rotor 20 engages flange 41 on plate 40, as shown in FIG. 7*b*. The rotation of rotor 20 causes plate 40 to rotate in a counter-clockwise direction. The shape of the notch 31 in the extended end of latch 30 is such that if latch 30 is sufficiently extended to engage a very small portion of flange 41, the rotation of rotor 20 will cause latch 30 to rotate fully to the second latch position. In the second latch position, latch 30 is fully engaged with flange 41. This design ensures that it will never occur that only a very small edge of latch 30 will be in contact with flange 41 and attempt to rotate plate 40.

As plate 40 rotates, notch 43 disengages pin 51, permitting pawl 50 to rotate towards rotor assembly 10, as biased by coil spring 60. Once plate 40 has moved sufficiently that notch 43 permits pin 51 to allow pawl 50 to move towards rotor assembly 10, the biasing force of coil spring 60 pulls pawl 50 upwards and into the path of the flat surface 23 of protrusion 21. This is shown in FIG. 7*c*. The rotation of the rotor assembly 10 is halted by pawl 50. When rotor assembly 10 stops rotating, shaft 120 also stops rotating. This halts the rotation of cable drum 110. Because cable drum 110 is fixedly connected to the sectional door 140 by means of one or more cables 130, sectional door 140 halts its rapid downward movement.

In an embodiment in which the rotor assembly 10 and the cable drum 110 are formed as a single component, as shown in FIG. 9, cable drum 110 obviously halts its rotation as rotor assembly 10 rotation is halted by pawl 50.

After sectional door 140 movement has been halted by the present invention, a user may wish to secure sectional door 140 in a closed position, or may need to lift sectional door 140 in order to remove an item located within the space enclosed by the sectional door 140. One example would be a car or other vehicle. With the help of others, as required, an individual can lift the weight of sectional door 140 without the assistance of broken or weakened springs 100.

As the user lifts the sectional door 140, cable drum 110, shaft 120, and attached rotor assembly 10 rotate in a clockwise direction. As rotor assembly 10 rotates clockwise, the sloped side 24 of protrusion 21 contacts pawl 50, biasing it away from rotor 20 as the rotation continues. At the same time, latch 30 that engaged flange 41 at the top of plate 40 is rotating clockwise as part of the rotor assembly 10. As latch 30 disengages flange 41 on plate 40, latch 30 falls back to the first latch position. Coil spring 60 biases plate 40 back to its first position. As pawl 50 is pushed away from rotor assembly 10 and plate 40 rotates clockwise to its first position, notch 43 re-engages pin 51. This prevents pawl 50 from moving towards rotor assembly 10 after protrusion 21 has passed and would no longer inhibit the movement of pawl 50 towards rotor 20. The device has thus been disengaged by manually lifting the door a short distance.

In a preferred embodiment, the shape of notch 43 formed in plate 40 determines the timing of the interaction between pawl 50 and flat surface 23 as the present invention engages to halt the movement of sectional door 140. Notch 43 includes two seating points that restrain all movement of pawl 50. During normal operation of the sectional door 140, pawl 50 is positioned away from rotor 20, and is locked in a position so it cannot move towards rotor 20. As plate 40 begins to rotate, pawl 50, as biased by coil spring 60, moves towards rotor assembly 10. Once plate 40 has rotated sufficiently to permit pin 51 to slip into the second area of notch 43, pawl 50 is held firmly in place in a position where it will engage with the flat surface 23 of rotor 20. In this position, "bouncing" action of latch 30 or plate 40 will not suffice to permit pawl 50 to move out of the path of rotor 20. When pawl 50 is forced downward by the clockwise rotation of rotor 20, this force will cause plate 40 to rotate slightly, permitting pin 51 to move out of the second area of notch 43.

If at any time the manual lifting force is removed from the sectional door 140, so that sectional door 140 again begins a rapid and dangerous descent, the present invention will re-engage as described previously. In this manner, a user can, by trial-and-error, realize that the sectional door 140 is not functioning normally; rapid downward motion is blocked; but upward motion is possible, and slow downward motion is possible. If a sectional door 140 held up by a manual force is released, it falls a short distance until the present invention re-engages. By repeated efforts, therefore, a user can easily discover how to raise or lower an unbalanced sectional door 140 that includes the present invention without the risk of serious injury or death that accompanies inventions in the prior art.

Other Embodiments

The present invention may be embodied in numerous other specific forms without departing from its spirit or essential characteristic of sensing the overly rapid descent of a sectional door and halting that descent. The herein described non-limiting embodiments are therefore to be considered in all respects only as illustrative, and not restrictive.

Other methods and positions for mounting a sensing component such as rotor assembly 10 are also included within the scope of this invention, so long as the rotation of shaft 120 is coupled to the rotation of rotor 20. This coupling may be achieved through means that include, but are not limited to, mechanical means such as gearing or friction, electrical, optical, electro-optical, and magnetic means.

Figure 8:
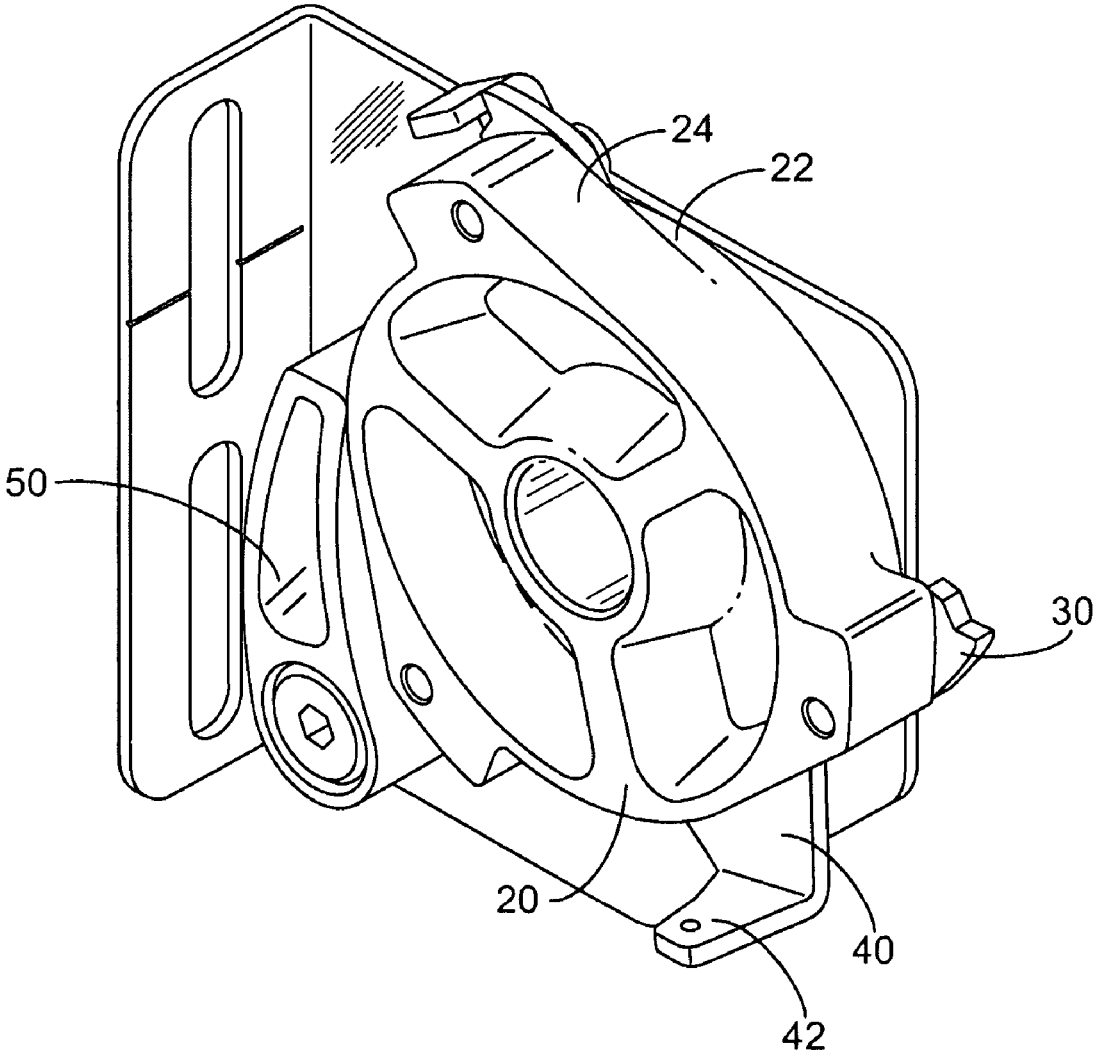
FIG. 8 shows an embodiment of the present invention, without all of its components, in the general position it would be found when placed at the center of a torsion shaft.

When mounted directly on shaft 120, rotor assembly 10 can be positioned in various ways depending on manufacturing requirements. In one embodiment, rotor assembly 10 is mounted on shaft 120 in the center 121, rather than at one of the ends where a cable drum 110 is typically located. A partial illustration of the present invention as used for this embodiment is shown in FIG. 8, with pawl 50 and plate 40 rotated somewhat to permit free movement of sectional door 140 directly beneath the center 121 of shaft 120 where the device is mounted. This embodiment is particularly effective for retrofitting a pre-existing sectional door 140 with the safety advantages of the present invention. Depending on the shape and configuration of the pre-existing sectional door 140, a retro-fitting may also be accomplished by placing the present invention at either end of shaft 120, adjacent to a cable drum 110.

In one embodiment, cable drum 110 and rotor assembly 10 of the present invention are formed as a single component to obtain efficiencies in cost, manufacturing, installation, and effectiveness of the stopping force. This embodiment has the advantage that cable drum 110 is halted implicitly when rotor assembly 10 halts, as they are a single component, without the need for rotor assembly 10 to transfer a large impulse through a very short length of shaft 120, exerting great strain on set screws or similar components fastening rotor assembly 10 and cable drum 110 to shaft 120.

Figure 5:
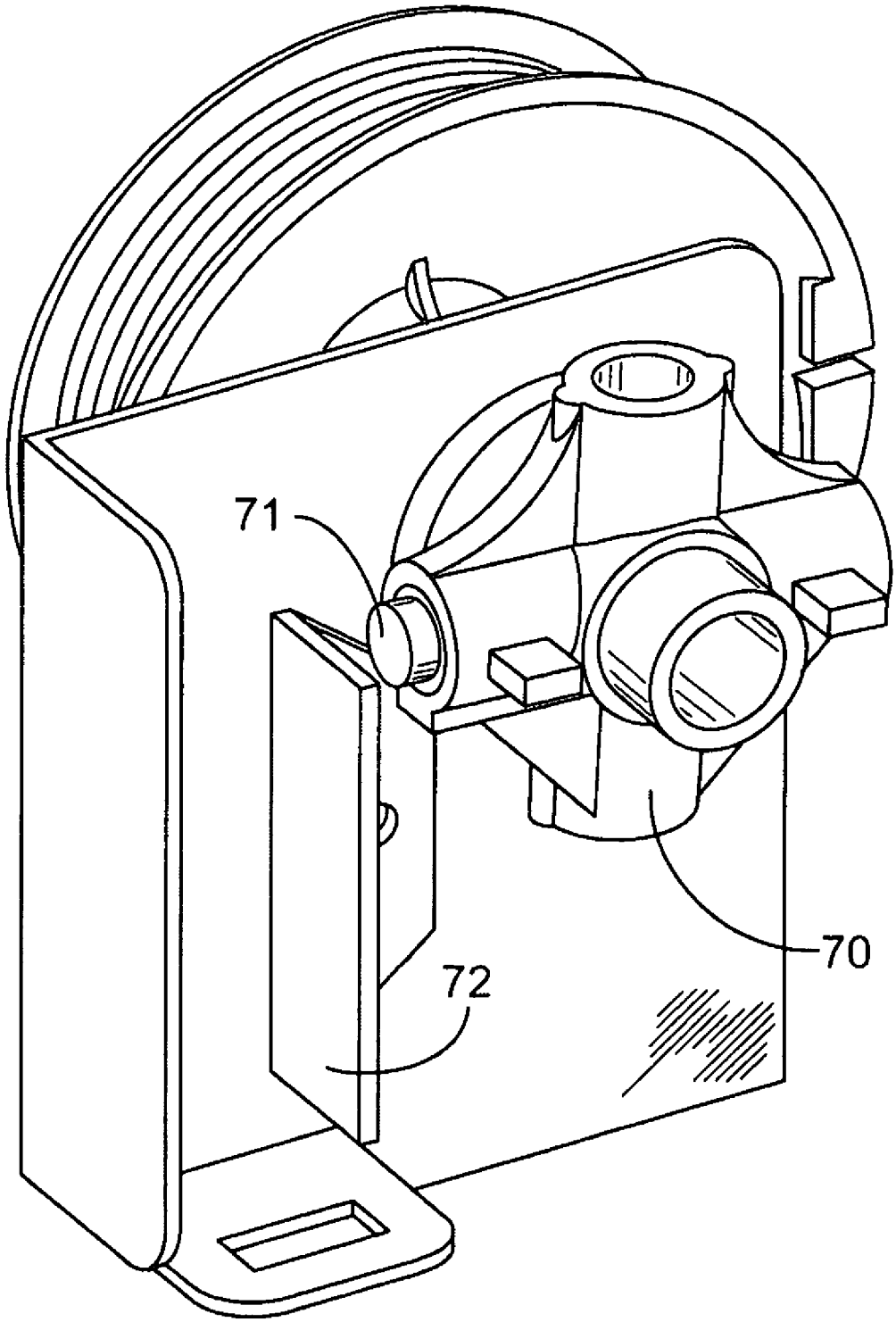
FIG. 5 shows an alternate embodiment of the present invention.

Other shapes and configurations for rotor assembly 10 are also included within the scope of this invention. The rotor 20 may be formed in various polygonal shapes that include a stopping surface that a member can engage to halt rotation of rotor assembly 10. In one alternative embodiment, shown in FIG. 5, rotor 70 includes pins 71 that slide in and out under the force of gravity during normal operation of a sectional door 140. If sectional door 140 begins an overly rapid decent, centrifugal force causes pins 71 to move to an outer position where a pin 71 strikes a stationary plate 72 that halts movement of rotor 70, thus halting the movement of the cable drum and the movement of sectional door 140.

Numerous methods are encompassed within the present invention for coupling a rotor to a moveable member that moves to a second position when the angular velocity of the rotor exceeds a threshold value. Latches 30 described previously are merely one preferred embodiment of this component of the present invention. Other mechanical, electrical, optical, or other technological means may be used to sense the angular velocity of the rotor and cause another component of the invention to change to a second position in which the components of the invention engage to halt rotation of the rotor.

The scope of the present invention is indicated by the appended claims, rather than by the foregoing description. All changes which come within the meaning and range of equivalency of the claims are to be embraced within their scope.

What is claimed is:

1. A system comprising:

a rotatable shaft;

a rotor mounted on said shaft, said rotor comprising a stopping surface and a latch, the latch being mounted to said rotor, such that when said rotor rotates in a first direction at greater than a threshold angular velocity, said latch moves from a first latch position to a second latch position;

a plate, comprising means for restraining and an engagement point, the engagement point lying in the path of said latch when said latch is in said second latch position, the engagement of said engagement point and said latch causing said plate to move from a first plate position to a second plate position;

a pawl comprising means for holding and means for biasing, wherein said means for holding engages said means for restraining on said plate when said plate is in said first plate position, substantially preventing movement of said pawl, and where said means for holding does not substantially engage said means for restraining on said plate when said plate is in said second plate position, and wherein said means for biasing biases said pawl when said means for holding on said pawl is not engaged with said means for restraining on said plate, such that said pawl engages with said stopping surface of said rotor, causing said rotation of said rotor in said first direction to cease.

2. The system of claim 1, wherein the latch is returned to the first latch position as the rotor is rotated in a second rotor direction, the second rotor direction being opposite the first rotor direction.

3. The system of claim 1, wherein the rotor further comprises at least one sloped contact surface such that when the rotor is rotated in the second rotor direction, the at least one sloped contact surface contacts the pawl thereby disengaging the pawi from the stopping surface of the rotor and disengaging the means for holding on the pawl from the means for restraining on the plate.

4. The system of claim 1, further comprising means for mechanically sensing the angular velocity of the rotor.

5. The system of claim 1, further comprising means for electrically sensing the angular velocity of the rotor.

6. The system of claim 1, further comprising means for optically sensing the angular velocity of the rotor.

7. The system of claim 1, further comprising means for sensing the angular velocity of the rotor that causes another component of the system to change to a second position in which the components of the system engage to halt the rotation of the rotor.

8. The system of claim 1, wherein the system is capable of being retrofitted to a pre-existing sectional door.

9. The system of claim 1, wherein the rotor further comprises a cable drum component for winding and storing a cable of the system.

10. A system comprising:

a rotatable shaft;

a rotor mounted on said shaft, comprising a protrusion extending from the perimeter of said rotor, said protrusion comprising a first surface being substantially parallel to a radius of said rotor, and a second surface comprising a gradual slope from the perimeter of said rotor to substantially the full extent of said protrusion;

a substantially elongate latch, comprising a first latch end and a second latch end, the second latch end adjustably mounted to said rotor, such that when said rotor rotates in a first direction at greater than a threshold angular velocity, centrifugal force biases said first latch end away from the center of said disc into an outer latch position;

a plate, comprising an attachment point, means for restraining and an engagement point, the engagement point lying in the path of said first latch end when in said outer latch position, the engagement of said engagement point and said first latch end causing said plate to move from a first plate position to a second plate position;

a pawl comprising a first end, a second end, an attachment point, and means for holding, the second end being adjustably mounted in the vicinity of said rotor, wherein said means for holding engages said means for restraining on said plate when said plate is in said first plate position, substantially preventing movement of said pawl towards said rotor, and wherein said means for holding does not substantially engage said means for restraining on said plate when said plate is in said second plate position, means for biasing comprising a first end attached to said attachment point of said plate, and a second end attached to said attachment point of said pawl, said means for biasing exerting a biasing force upon said first end of said pawl towards the path of said first surface of said rotor when said rotor rotates in said first direction.

11. The system of claim 10, wherein the latch is returned to an inner latch position as the rotor is rotated in a second direction, the second direction being opposite the first direction of the rotor.

12. The system of claim 11, wherein as the rotor is rotated in the second direction, the second surface of the rotor contacts the pawl thereby disengaging the pawl from the first surface of the rotor and disengaging the means for holding on the pawl from the means for restraining on the plate.

13. The system of claim 10, further comprising means for mechanically sensing the angular velocity of the rotor.

14. The system of claim 10, further comprising means for electrically sensing the angular velocity of the rotor.

15. The system of claim 10, further comprising means for optically sensing the angular velocity of the rotor.

16. The system of claim 10, further comprising means for sensing the angular velocity of the rotor that causes another component of the system to change to a second position in which the components of the system engage to halt the rotation of the rotor.

17. The system of claim 10, wherein the system is capable of being retrofitted to a pre-existing sectional door.

18. The system of claim 10, wherein the rotor further comprises a cable drum component for winding and storing a cable of the system.

* * * * *